US011964812B2

(12) United States Patent
Kang et al.

(10) Patent No.: US 11,964,812 B2
(45) Date of Patent: Apr. 23, 2024

(54) DUAL PRESS SPRAY HEAD

(71) Applicant: GANGDONG GROUP CO., LTD., Chungbuk (KR)

(72) Inventors: Sanghoon Kang, Seoul (KR); Yongwook Jeong, Incheon (KR); Dongkwan Yu, Seongnam-si (KR)

(73) Assignee: GANGDONG GROUP Co., Ltd., Chungbuk (KR)

( * ) Notice: Subject to any disclaimer, the term of this patent is extended or adjusted under 35 U.S.C. 154(b) by 0 days.

(21) Appl. No.: 18/276,389

(22) PCT Filed: Apr. 15, 2022

(86) PCT No.: PCT/KR2022/005487
§ 371 (c)(1),
(2) Date: Oct. 5, 2023

(87) PCT Pub. No.: WO2023/191168
PCT Pub. Date: Oct. 5, 2023

(65) Prior Publication Data

US 2024/0034542 A1 Feb. 1, 2024

(30) Foreign Application Priority Data

Apr. 1, 2022 (KR) ..... 10-2022-0041007

(51) Int. Cl.
*B65D 83/20* (2006.01)
*B65D 83/28* (2006.01)
*B65D 83/44* (2006.01)

(52) U.S. Cl.
CPC ..... *B65D 83/201* (2013.01); *B65D 83/28* (2013.01); *B65D 83/44* (2013.01)

(58) Field of Classification Search
CPC ..... B65D 83/201; B65D 83/28; B65D 83/44; B65D 83/206
(Continued)

(56) References Cited

U.S. PATENT DOCUMENTS 4,077,549 A * 3/1978 Beard ..... B05B 11/1057 222/402.15
7,204,393 B2 * 4/2007 Strand ..... B65D 83/206 222/402.21
(Continued)

FOREIGN PATENT DOCUMENTS

JP 2016-117519 A 6/2016
KR 20-2009-0012318 U 12/2009
(Continued)

OTHER PUBLICATIONS

Korean Office Action dated Jun. 20, 2022, in Counterpart Korean Patent Application No. 10-2022-0041007 (4 Pages in Korean, 4 Pages in English).
(Continued)

*Primary Examiner* — Paul R Durand
*Assistant Examiner* — Michael J. Melaragno
(74) *Attorney, Agent, or Firm* — NSIP Law

(57) ABSTRACT

Disclosed is a dual press spray head including: a head portion coupled to a top of a can having an internal space in which contents are accommodated; a discharge portion communicating with an inside of the head portion and discharging the contents to an outside; a gun-type portion mounted to the head portion and coupled to the discharge portion to operate the discharge portion; and a press-type portion mounted to the head portion and pressing the head portion in a downward direction of the can, wherein one side of the press-type portion comes into contact with the gun-type portion so that the head portion and the gun-type portion are pressurized simultaneously in the downward direction of the can to operate the discharge portion.

5 Claims, 10 Drawing Sheets

(58) Field of Classification Search
USPC ..... 222/402.15
See application file for complete search history.

(56) References Cited

U.S. PATENT DOCUMENTS

| | | | | |
|---|---|---|---|---|
| 8,444,026 | B2 * | 5/2013 | Adams | B65D 83/206 222/402.15 |
| 9,061,816 | B2 * | 6/2015 | Best | B65D 83/206 |
| 9,475,635 | B2 * | 10/2016 | Driskell | B65D 83/345 |
| 10,647,501 | B2 * | 5/2020 | Richard | B65D 83/202 |
| 10,654,644 | B2 * | 5/2020 | Sell | B65D 83/206 |
| 11,034,507 | B2 * | 6/2021 | Spang, Jr. | B65D 83/206 |
| 11,142,390 | B1 * | 10/2021 | Freudenberg | B65D 83/205 |
| 2004/0222246 | A1 * | 11/2004 | Bates | B65D 83/202 222/402.15 |
| 2005/0199653 | A1 * | 9/2005 | Warner | B65D 83/203 222/174 |
| 2011/0192867 | A1 * | 8/2011 | Best | B65D 83/206 222/402.13 |
| 2013/0228593 | A1 * | 9/2013 | Adams | B65D 83/206 222/402.13 |
| 2014/0084026 | A1 * | 3/2014 | Gillespie | B65D 83/201 222/402.15 |
| 2018/0099808 | A1 * | 4/2018 | Richard | B65D 83/206 |
| 2020/0062489 | A1 * | 2/2020 | Spang, Jr. | B65D 83/206 |
| 2023/0271769 | A1 * | 8/2023 | VanBecelaere | B65D 83/22 222/402.13 |

FOREIGN PATENT DOCUMENTS

| | | | | |
|---|---|---|---|---|
| KR | 10-1778896 | B1 | 9/2017 | |
| WO | WO 2011/159330 | A1 | 12/2011 | |
| WO | WO-2015200248 | A1 * | 12/2015 | B65D 83/201 |

OTHER PUBLICATIONS

Korean Office Action dated Sep. 16, 2022, in Counterpart Korean Patent Application No. 10-2022-0041007 (3 Pages in Korean, 3 Pages in English).
International Search Report for Application No. PCT/KR2022/005487 dated Sep. 28, 2022 (3 Pages in Korean, 4 Pages in English).
International Preliminary Report on Patentability for Application No. PCT/KR2022/005487 dated Sep. 28, 2022 (5 Pages in Korean, 5 Pages in English).
Korean Office Action dated Jun. 20, 2022, in Counterpart Korean Patent Application No. 10-2022- 0041007 (4 Pages in Korean).
Korean Office Action dated Sep. 16, 2022, in Counterpart Korean Patent Application No. 10- 2022-0041007 (3 Pages in Korean).

* cited by examiner

DUAL PRESS SPRAY HEAD

CROSS REFERENCE TO RELATED APPLICATIONS

This application is a U.S. National Stage Application of International Application No. PCT/KR2022/005487, filed on Apr. 15, 2022, which claims the benefit under 35 USC 119(a) and 365(b) of Korean Patent Application No. 10-2022-0041007, filed on Apr. 1, 2022, in the Korean Intellectual Property Office, the entire disclosure of which is incorporated herein by reference for all purposes.

BACKGROUND

Field

The present disclosure relates to a dual press spray head, and more particularly to a dual press spray head to be used according to a user's preference, environment, purpose, and the like.

Related Art

In general, a spray head is coupled to a can in which liquid and liquefied gas are sealed, and the spray head is configured to discharge the sealed contents to an outside.

In this case, a stem forming a nozzle connected to the spray head located at the top of the can is installed. In addition, a straw connected from the stem extends to the liquid inside the can. Accordingly, the liquefied gas pushes the liquid to the nozzle so that the liquid is injected through the nozzle.

A spray can combined with the spray head configured as above injects sol-type liquid substance having functional properties in the form of sol. Depending on the type of stored liquid substance, it is classified into antibacterial spray cans, air freshener spray cans, cleaner spray cans, paint spray cans, etc.

Unlike spray cans for spraying liquids, there are also gas spray cans for spraying gases.

Examples of the gas spray cans may include a dust removal spray can and a gas torch spray can.

The dust removal spray can is used to remove dust or foreign substances from an object by spraying high-pressure gas through a nozzle, and the gas torch spray can is used to heat or cut a specific part with a flame by spraying flammable gas at high pressure.

For the convenience of operation of the spray can, a separate device is generally coupled to the top of the spray can, and this device is connected to a stem (nozzle) of the spray can to inject the contents therein.

Regarding this device, Korean Patent No. 10-0499968 discloses the "aerosol jetting device", specifically, an aerosol jetting device including: a container in which an aerosol containing an undiluted solution containing a pest control component and a propellant is sealed; a valve stem protruding from the top of the container; and an operating unit inserted into the valve stem and having a passage through which the valve stem and an outside communicate with each other, wherein the aerosol in the container is jetted to the outside by operating this operation unit so that the concentration of the pest control component in the air does not decrease for at least 5 minutes in a space and thus it is easy to handle the aerosol jetting device and achieve an excellent pest control effect.

As another related art, Korean Patent No. 10-0768454 discloses an "aerosol atomizer", specifically an aerosol atomizer including: a container having a cylindrical body, a lower cover, and an upper cover to accommodate contents such as medicines, wherein a maximum diameter of the body is 50 mm or more and a portion extending downward by 10 mm or more from an upper end of the body is a diameter reduction portion in which the diameter decreases toward the top, and wherein a diameter of the upper end of the body is 70 to 90% of the maximum diameter; and a cap mounted to the top of the container and having an injection hole and an injection button, wherein contents in the container is injected by operating the injection button, and wherein the injection operating means are easy to operate.

Meanwhile, since the spray head coupled to the can is provided either as a press type to be pressurized to spray contents in a direction toward a spray can or as a gun-type coupled to a side surface of a spray hole and to be pulled by a user to spray contents, it is difficult to use the spray head according to the user's preference, environment, purpose, etc.

SUMMARY

An aspect of the present disclosure provides a dual press spray head coupled to a can and having a press type to be pressurized in a direction toward the spray can to spray contents and a gun type coupled to a side surface of an injection hole and to be pulled by a user to spray contents, so that the user can selectively use the press type or the gun type according to the user's preference, environment, purpose, etc.

The technical objects of the inventive concept are not limited to the above-mentioned ones, and the other unmentioned technical objects will become apparent to those skilled in the art from the following description.

In one aspect, there is provided a dual press spray head including: a head portion coupled to a top of a can having an internal space in which contents are accommodated; a discharge portion communicating with an inside of the head portion and discharging the contents to an outside; a gun-type portion mounted to the head portion and coupled to the discharge portion to operate the discharge portion; and a press-type portion mounted to the head portion and pressing the head portion in a downward direction of the can, wherein one side of the press-type portion comes into contact with the gun-type portion so that the head portion and the gun-type portion are pressurized simultaneously in the downward direction of the can to operate the discharge portion.

The head portion may include a first end portion coupled to the top of the can, and a second end formed larger than diameter of the first end and coupled to one side of an outer circumferential surface of the first end to extend to an upper side of the first end.

The second end may enter in a direction toward the first end portion when the press-type portion is pressurized.

The discharge portion may include a discharge injection hole through which the contents are discharged; and a spray nozzle part having one side connected to the discharge injection hole, and the other side extending to the contents accommodated inside the can.

The spray nozzle part may include a coupling part coupled to a contents nozzle having elasticity so that the contents are able to move to the spray nozzle part.

The coupling part may further comprise a prevention part for preventing the contents from leaking out when the contents nozzle part is coupled.

The press-type portion may include a pressure guide part mounted to an upper side of the head and forming a pattern indicating the press-type portion.

The gun-type portion may include a contact part in contact with the pressure guide part.

The contact part may come into contact with one side of the spray nozzle part, wherein a portion of the contact part in contact with the one side of the spray nozzle part forms an inclined surface to prevent the gun-type portion from tilting when the press-type portion is pressurized.

The spray nozzle part may be formed as an inclined surface corresponding to the contact part.

As described above, in the present disclosure, a dual press spray head coupled to a can has an effect of selectively use a press type to be pressurized in a direction toward the spray can to spray contents and a gun type coupled to a side surface of an injection hole and to be pulled by a user to spray contents according to the users preference, environment, purpose, etc.

Effects of the present disclosure are not limited to the aforementioned effects, and other effects not mentioned will be clearly understood by those skilled in the art from the description below.

DESCRIPTION OF EXEMPLARY EMBODIMENTS

Figure 1:
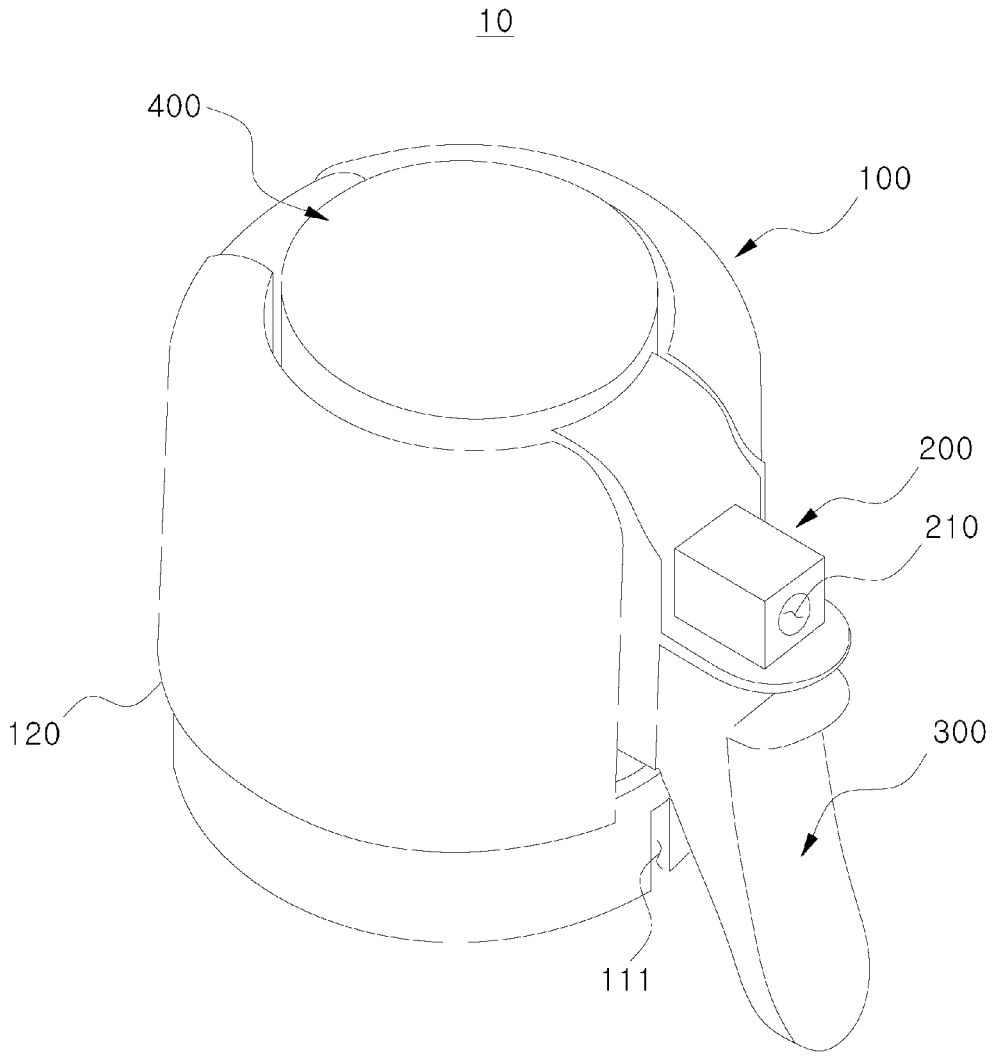
FIG. 1 is a view showing a dual press spray head according to an embodiment of the present disclosure.

A dual press spray head according to the present disclosure includes: a head portion coupled to a top of a can having an internal space in which contents are accommodated; a discharge portion communicating with an inside of the head portion and discharging the contents to an outside; a gun-type portion mounted to the head portion and coupled to the discharge portion to operate the discharge portion; and a press-type portion mounted to the head portion and pressing the head portion in a downward direction of the can, wherein one side of the press-type portion comes into contact with the gun-type portion so that the head portion and the gun-type portion are pressurized simultaneously in the downward direction of the can to operate the discharge portion.

The head portion may include a first end portion coupled to the top of the can, and a second end formed larger than diameter of the first end and coupled to one side of an outer circumferential surface of the first end to extend to an upper side of the first end.

The second end may enter in a direction toward the first end portion when the press-type portion is pressurized.

The discharge portion may include a discharge injection hole through which the contents are discharged; and a spray nozzle part having one side connected to the discharge injection hole, and the other side extending to the contents accommodated inside the can.

The spray nozzle part may include a coupling part coupled to a contents nozzle having elasticity so that the contents are able to move to the spray nozzle part.

The coupling part may further comprise a prevention part for preventing the contents from leaking out when the contents nozzle part is coupled.

The press-type portion may include a pressure guide part mounted to an upper side of the head and forming a pattern indicating the press-type portion.

The gun-type portion may include a contact part in contact with the pressure guide part.

The contact part may come into contact with one side of the spray nozzle part, wherein a portion of the contact part in contact with the one side of the spray nozzle part forms an inclined surface to prevent the gun-type portion from tilting when the press-type portion is pressurized.

The spray nozzle part may be formed as an inclined surface corresponding to the contact part.

The present disclosure may be modified in various ways and may have various embodiments. Specific embodiments will be illustrated in the drawings and described in detail.

It is however to be understood that the present disclosure is not intended to be limited to the specific embodiments, but includes all modifications, equivalents and/or substitutions which fall within the spirit and technological scope of the present disclosure. Like reference numerals refer to like elements throughout the description of each figure.

It will be understood that when an element is referred to as being "connected" or "coupled" to another element, it can be directly connected or coupled to the other element or intervening elements may be present. In contrast, it will be understood that when an element is referred to as being "directly connected" or "directly coupled" to another element, there are no intervening elements present.

The terminology used herein is for the purpose of describing particular embodiments only and is not intended to be limiting of the present disclosure. As used herein, the singular forms "a", "an," and "the" are intended to include the plural forms as well, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

Hereinafter, embodiments of the present disclosure will be described with reference to the accompanying drawings. In the drawings, it is noted that the same elements or parts will be given the same reference numbers. In the course of the description of the present disclosure, the detailed descriptions on the related functions or construction will be omitted in order to prevent the subject matters of the present disclosure from becoming ambiguous.

A dual press spray head 10 according to an embodiment of the present disclosure includes a head portion 100, a discharge portion 200, a gun-type portion 300, and a press-type portion 400.

Figure 2:
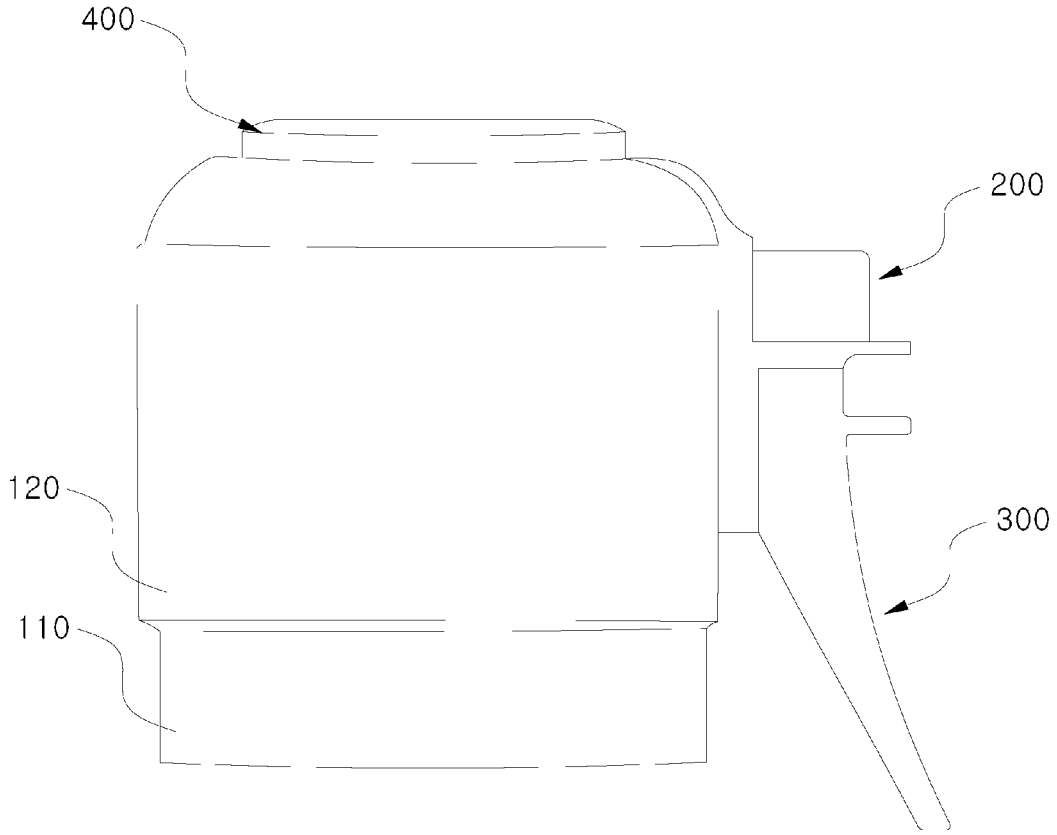
FIG. 2 is a view showing the dual press spray head of FIG. 1 as viewed from another angle.
Figure 3:
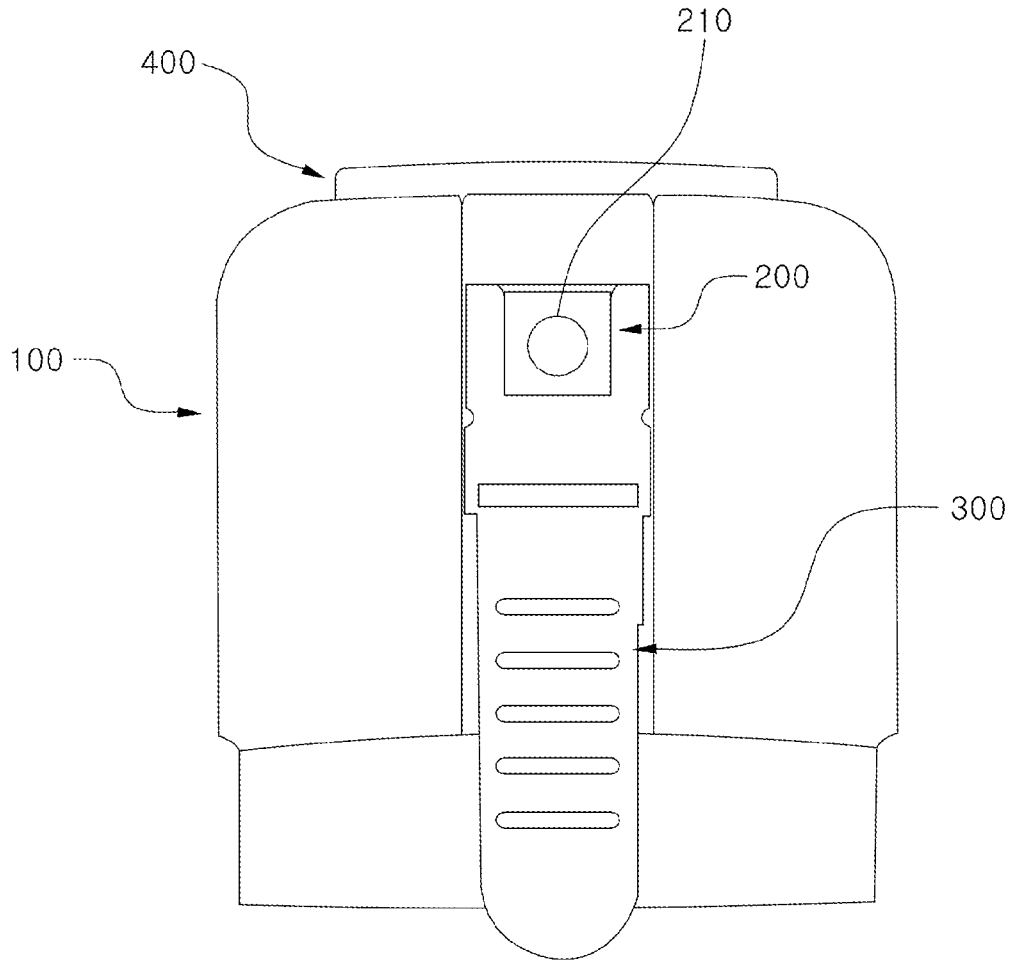
FIG. 3 is a view showing the dual press spray head of FIG. 1 as viewed from yet another angle.
Figure 4:
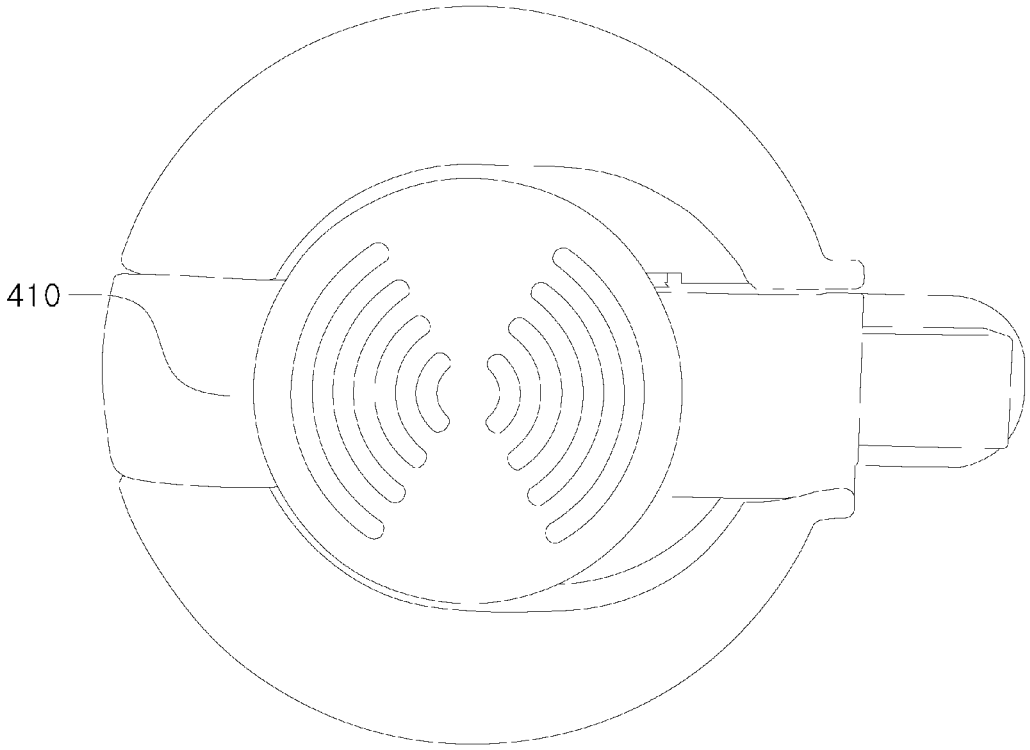
FIG. 4 is a view showing a pressure guide part of the dual press spray head of FIG. 1.
Figure 5:
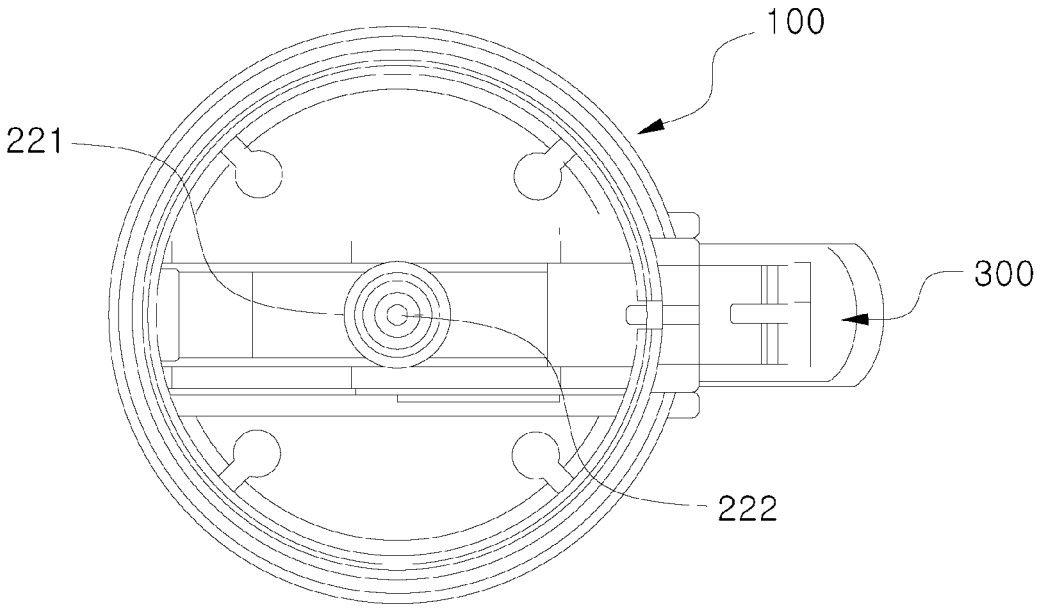
FIG. 5 is a view showing a rear side of the dual press spray head of FIG. 1.

FIG. 1 is a view showing a dual press spray head according to an embodiment of the present disclosure, FIG. 2 is a view showing the dual press spray head of FIG. 1 as viewed from another angle, FIG. 3 is a view showing the dual press spray head of FIG. 1 as viewed from yet another angle, FIG. 4 is a view showing a pressure guide part of the dual press spray head of FIG. 1, and FIG. 5 is a view showing a rear side of the dual press spray head of FIG. 1.

Referring to FIGS. 1 to 5, the head portion 100 is coupled to a top of a can (not shown) having an internal space in which contents are accommodated.

In addition, the can may contain liquid and compressed gas as contents therein, or may contain gas (liquefied gas).

In addition, the range of can described in the present disclosure includes, of course, a well-known aerosol can.

Therefore, the inside of the can in use is maintained at a high pressure compared to the outside, and this pressure is used as an energy source to discharge the contents inside the can to the outside.

The head portion 100 may include a first end portion 110 and a second end portion. Here, the first end portion 110 may be coupled to a top of the can. Also, the second end portion 120 may be formed larger than a diameter of the first end portion 110 and may be coupled to one side of an outer circumferential surface of the first end portion 110 to extend to an upper side of the first end portion 110.

That is, in a case where a user uses a press-type portion 400 with the first end portion 110 coupled to the upper side of the second end portion 120, if the user presses the second end portion 120, the second end portion 120 may press the first end portion 110.

In addition, the second end portion 120 may have a coupling protrusion 121 formed therein for coupling with one side of the outer circumferential surface of the first end portion 110, and the first end portion 110 may have a coupling hole 111 formed therein for coupling with the coupling protrusion 121.

In this case, the coupling hole 111 may have a vertical hole formed in a can direction so that the second end portion 120 can slide and be pressurized toward the first end portion 110.

Meanwhile, when the second end portion 120 is pressurized toward the first end portion 110 as a result of pressuring the press-type portion 400, the second end portion 120 may be pressurized by a spring (not shown).

The discharge portion 200 communicates with the inside of the head portion 100 to discharge contents to the outside. To this end, the discharge portion 200 may include a discharge injection hole 210 and a spray nozzle part 220.

Here, the discharge injection hole 210 may communicate with the inside of the head portion 100 and protrude toward the outside of the head portion 100.

In addition, the discharge injection hole 210 may have a hole formed therein to discharge contents.

In this case, the discharge injection hole 210 may be manufactured in various hole shapes so that the contents can be sprayed in various shapes.

That is, the discharge injection hole 210 may be formed in various diameters.

In addition, one side of the spray nozzle part 220 may be connected to the discharge injection hole 210 and the other side thereof may extend to the contents inside the can.

In addition, the spray nozzle part 220 may further include a coupling part 221.

Here, the coupling part 221 may be coupled to a contents nozzle part (not shown) having elasticity so that the contents are able to move to the spray nozzle part 220.

Here, the contents nozzle part (not shown) may be a valve stem.

This valve stem is formed on the upper side of the can, and the contents inside the can may be discharged in a direction toward the head portion 100 through the valve stem.

That is, when an external force is applied, the valve stem is pressurized downward and a passage inside the valve stem is opened. In this case, the contents are discharged to the outside through the valve stem due to the strong pressure inside the can.

In this case, when the external force acting on the valve stem is removed, the valve stem, of course, recovers upward again.

In addition, the coupling part may further include a prevention part 222 that prevents the contents from leaking out when the coupling part is coupled to the contents nozzle part.

The prevention part 222 may be formed in a hat shape (a shape gradually narrowing upward).

The shape of the prevention part 222 gradually narrows upward, and the narrowing part presses the spray nozzle part 220 to prevent the contents from being discharged to the outside.

In this case, the spray nozzle part 220 may be manufactured to correspond to the hat shape of the prevention part 222.

The gun-type portion 300 is mounted to the head portion 100 and coupled to the discharge portion 200 to operate the discharge portion 200.

To this end, the gun-type portion 300 may include a contact part 310.

The contact part 310 may come into contact with a pressure guide part 410 which will be described later.

In addition, the contact part 310 comes in contact with one side of the spray nozzle part 220, and a portion of the contact part 310 in contact with one side of the spray nozzle part 220 forms an inclined surface so that the gun-type portion 300 is prevented from tilting when the press-type portion 400 is pressurized.

In this case, the spray nozzle part 220 is formed as an inclined surface corresponding to the contact part 310, so when the gun-type portion 300 or the press-type portion 400 is pressurized, the gun-type portion 300 is tilted to one side and presses the spray nozzle part 220 to prevent the contents from escaping when the contents move to the contents nozzle.

The press-type portion 400 is mounted to the head portion 100 and presses the head portion 100 in a downward direction of the can. With one side of the press-type portion 400 contacts the gun-type portion 300, the head portion 100 and the gun-type portion 300 are simultaneously pressurized in the downward direction of the can, thereby operating the discharge portion 200.

In addition, the press-type portion 400 may include a pressure guide part 410 mounted to an upper side of the head portion 100 and having a pattern formed therein to indicate the press-type portion 400.

The pressure guide part 410 may have an arrow pattern or the like, and a non-slip part (not shown) may be installed to prevent a user's hand from slipping when the user presses the press-type portion 400.

Figure 6:
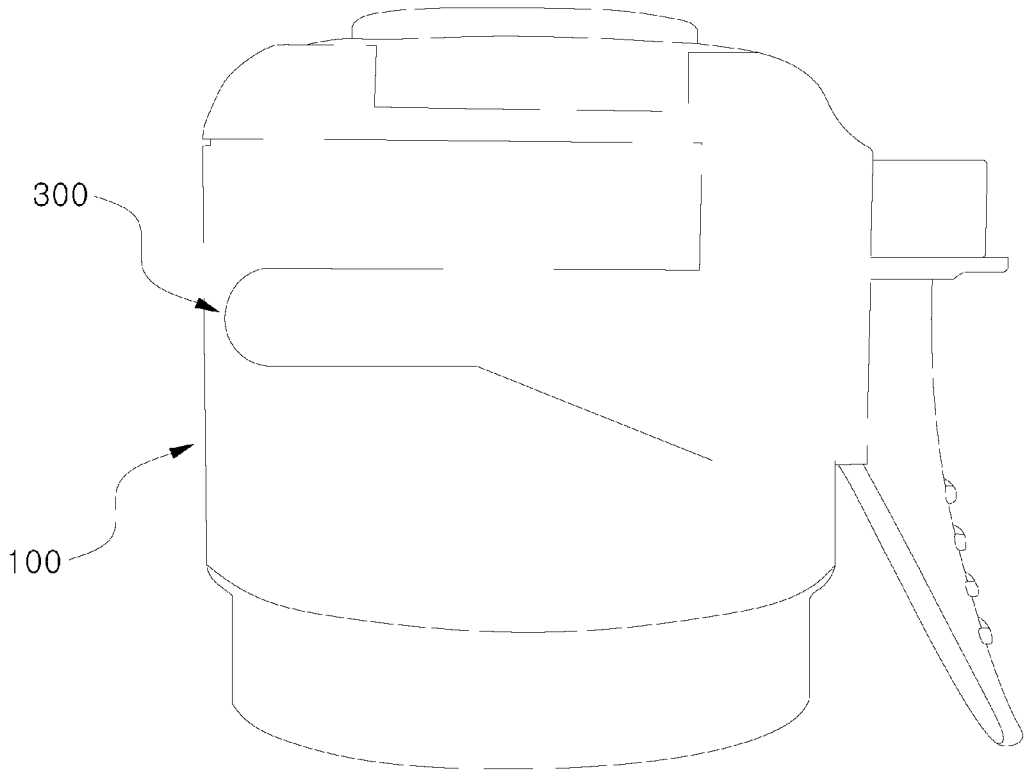
FIG. 6 is a view showing a press-type portion of the dual press spray head of FIG. 1.
Figure 7:
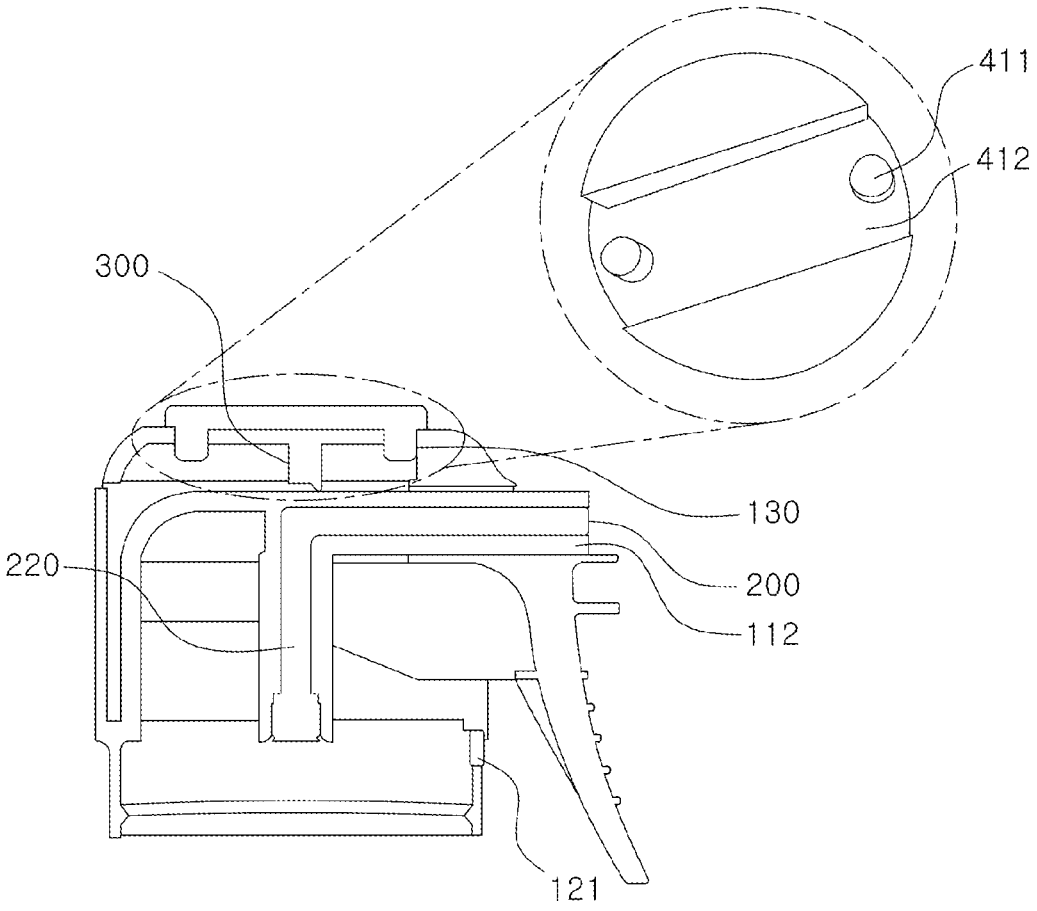
FIG. 7 is a view showing the dual press spray head of FIG. 1.
Figure 8:
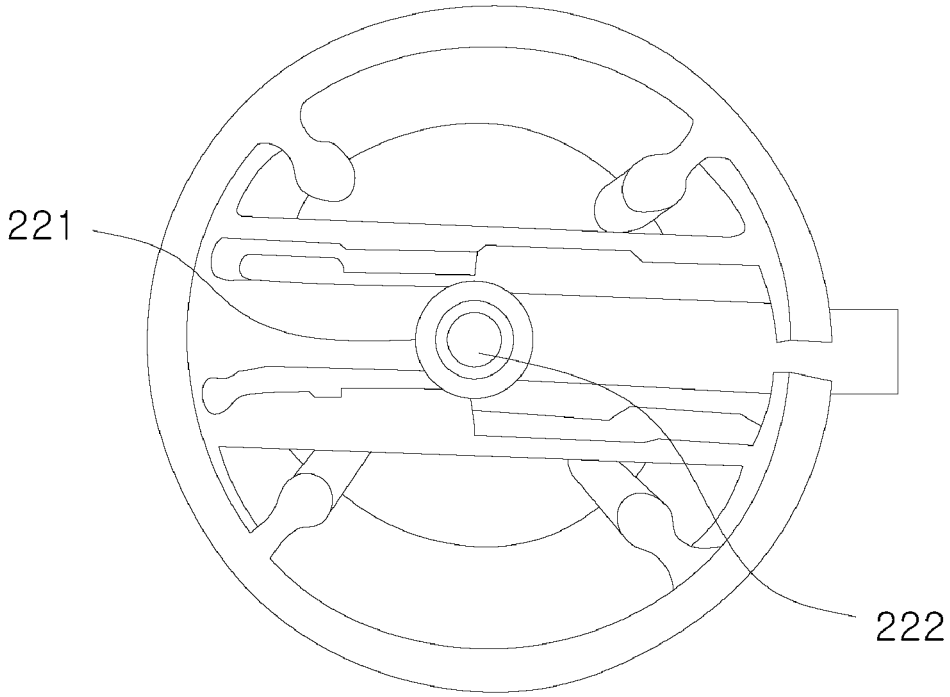
FIG. 8 is a view showing a coupling part of the press-type portion of FIG. 5.
Figure 9:
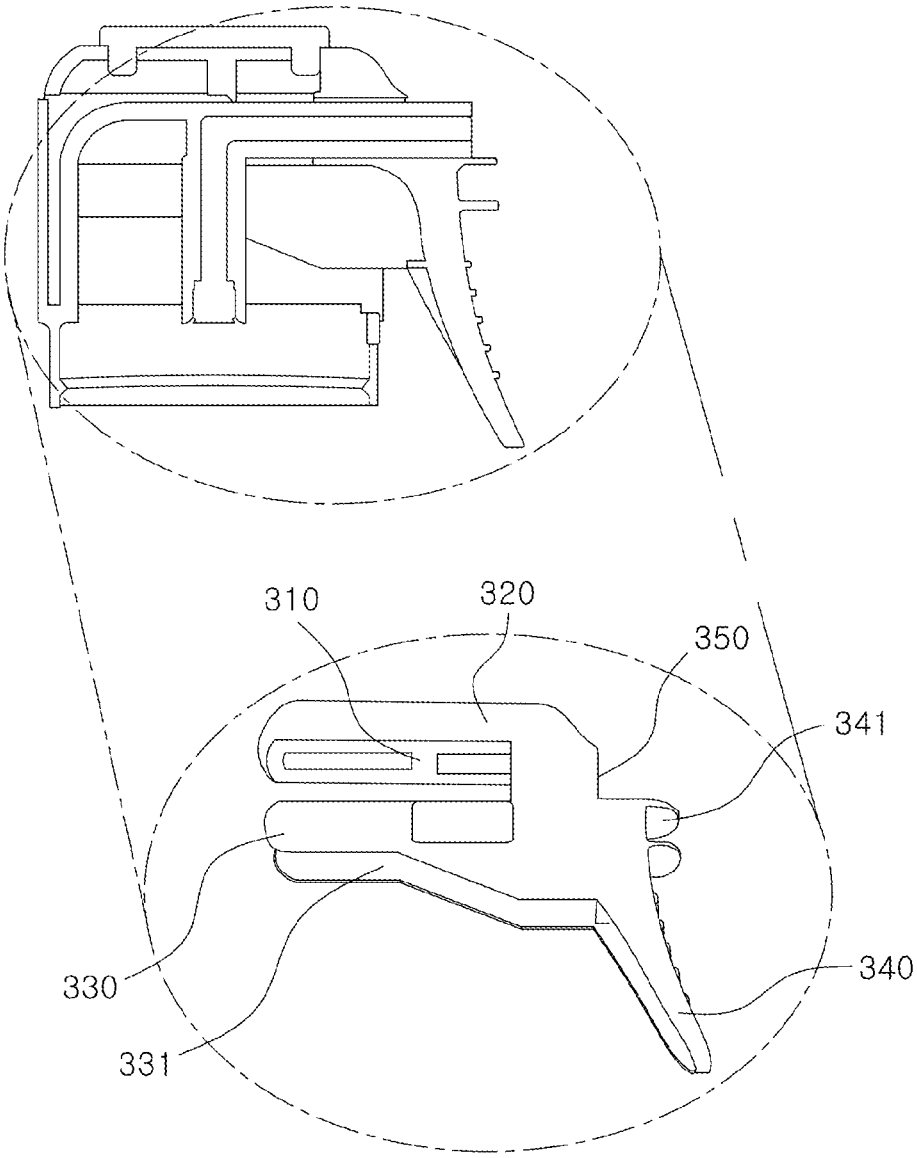
FIG. 9 is a view showing a gun-type portion of the dual press spray head of FIG. 1.
Figure 10:
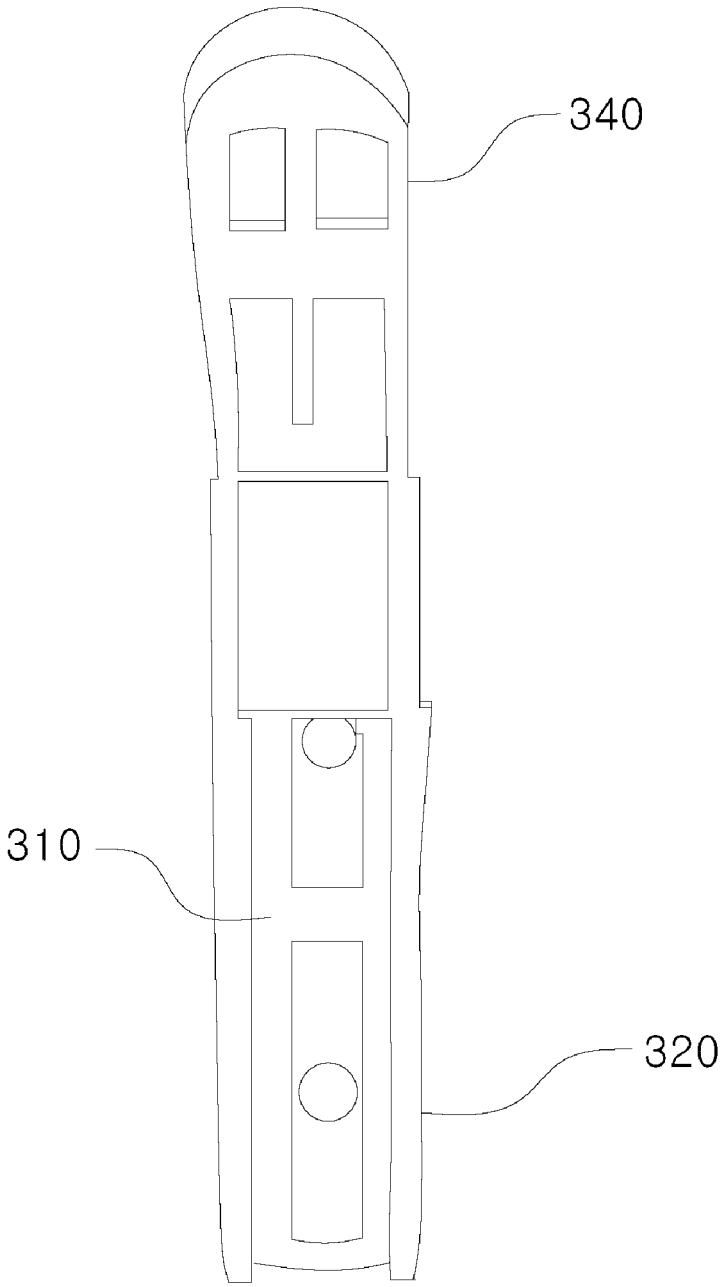
FIG. 10 is a view showing a contact part of the gun-type portion of FIG. 7.

FIG. 6 is a view showing the press-type portion of the dual press spray head of FIG. 1, FIG. 7 is a view showing the dual press spray head of FIG. 1, FIG. 8 is a view showing the coupling part of the press-type portion of FIG. 5, FIG. 9 is a view showing the gun-type portion of the dual press spray head of FIG. 1, and FIG. 10 is a view showing the contact part of the gun-type portion of FIG. 7.

Referring to FIGS. 6 to 10, the configuration of the dual press spray head 10 will be described in more detail.

The pressure guide part 410 of the press-type portion 400 may be mounted to the head portion 100. In addition, a press protrusion 411 may be formed to mount the pressure guide part 410 of the press-type portion 400 to the head portion 100. This is formed to be integrally coupled to the head portion 100.

In this case, the head portion 100 may be formed with a press protrusion groove 130 corresponding to the press protrusion 411.

Also, the press protrusion 411 may penetrate an outer wall of the head portion 100 and be then coupled to an outer surface of the gun-type portion 300.

In addition, the pressure guide part 410 may be formed in a circular shape, and a gun-type coupling part 412 coupled to the gun-type portion 300 may be formed at the center of the circular shape.

In this case, the gun-type coupling part 412 may be formed with a groove corresponding to the thickness, width, and length of the gun-type portion 300, so that the gun-type coupling part 412 is coupled to the gun-type portion 300.

However, this is merely an example, and the pressure guide part 410 may be formed in a shape other than the circular shape.

Also, the gun-type portion 300 may be fitted into the head portion 100.

In addition, the gun-type portion 300 may be integrally formed ad may include: a first gun-type member 320 in contact with the pressure guide part 410; a second gun-type member 330 into which the spray nozzle part 220 is inserted; a third gun-type member 340 formed with a handle to be pulled by a user; and a fourth gun-type portion 350 into which the discharge injection hole 210 is inserted.

In addition, the contact part 310 may be installed at the center of the first gun-type member 320.

The contact part 310 may be integrally formed with the first gun-type member 320.

In addition, the contact part 310 may be formed horizontally or vertically across the inner center of the first gun-type member 320.

In addition, the contact part 310 may be formed such that one surface thereof contacting the spray nozzle part 220 protrudes and a part of the protruding surface is inclined.

Meanwhile, the spray nozzle part 220 is formed at the first end portion 110 and may be mounted to a protective case 112 protecting the spray nozzle part 220.

That is, the contact part 310 may contact the protective case 112.

In addition, the first gun-type member 320 may have elasticity so as to maintain a curved shape corresponding to a curved outer surface of the head portion 100.

The elasticity of the first gun-type member 320 may not only for the first gun-type member 320, but may apply the same and uniformly to the gun-type portion 300 including the first to fourth gun-type members 320 to 350.

In addition, since the spray nozzle part 220 is integrally formed with the first end portion 110, the spray nozzle part 220 may be pressurized simultaneously when the press-type portion 400 is pressurized.

In addition, a through hole 331 may be formed in the second gun-type member 330 to allow the spray nozzle part 220 to pass therethrough.

A plurality of non-slip protrusions (not shown) may be formed in the third gun-type portion 340 to prevent slipping when a user holds the handle.

The fourth gun-type portion 350 may include a discharge-hole coupling hole (not shown) to which the discharge discharge injection hole 210 is coupled.

In this case, the third gun-type portion 340 may have a barrier 341 formed therein to prevent a residue from flowing down to the user's hand after the contents are sprayed from the discharge injection hole 210.

In addition, the barrier 341 can prevent the discharge portion 200 from being damaged by dropping of the dual spray head on the floor.

Therefore, with a dual press spray head, it is possible to selectively use a press type to be pressurized in a direction toward a spray can to spray contents and a gun type coupled to a side surface of an injection hole and to be pulled by a user to spray contents according to the user's preference, environment, purpose, etc.

The present disclosure has been described with reference to the particular illustrative embodiments. In this case, terms used in this application are used to only describe specific exemplary embodiments and are not intended to restrict the present disclosure. Accordingly, persons skilled in the relevant art can appreciate that many modifications and variations are possible in light of the above teachings. It is therefore intended that the scope of the present disclosure be limited not by this detailed description, but rather by the claims appended hereto.

What is claimed is:

1. A dual press spray head comprising:

a head portion coupled to a top of a can having an internal space in which contents are accommodated;

a discharge portion communicating with an inside of the head portion and discharging the contents to an outside;

a gun-type portion mounted to the head portion and coupled to the discharge portion to operate the discharge portion; and a press-type portion mounted to the head portion and pressing the head portion in a downward direction of the can, wherein one side of the press-type portion comes into contact with the gun-type portion so that the head portion and the gun-type portion are pressurized simultaneously in the downward direction of the can to operate the discharge portion, wherein the press-type portion comprises a pressure guide part mounted to an upper side of the head and forming a pattern indicating the press-type portion, wherein the gun-type portion comprises a contact part in contact with the pressure guide part, and wherein the contact part comes into contact with one side of the spray nozzle part, wherein a portion of the contact part in contact with the one side of the spray nozzle part forms an inclined surface to prevent the gun-type portion from tilting when the press-type portion is pressurized.

2. The dual press spray head of claim 1, wherein the spray nozzle part is formed as an inclined surface corresponding to the contact part.

3. The dual press spray head of claim 1, wherein:

the head portion comprises a first end portion coupled to the top of the can, and a second end formed larger than diameter of the first end and coupled to one side of an outer circumferential surface of the first end to extend to an upper side of the first end, and the second end enters in a direction toward the first end portion when the press-type portion is pressurized.

4. The dual press spray head of claim 3, wherein the discharge portion comprises:

a discharge injection hole through which the contents are discharged; and a spray nozzle part having one side connected to the discharge injection hole, and the other side extending to the contents accommodated inside the can.

5. The dual press spray head of claim 4, wherein:

the spray nozzle part comprises a coupling part coupled to a contents nozzle having elasticity so that the contents are able to move to the spray nozzle part, and the coupling part further comprises a prevention part for preventing the contents from leaking out when the contents nozzle part is coupled.

* * * * *